United States Patent [19]

Demuth

[11] Patent Number: 4,586,542

[45] Date of Patent: May 6, 1986

[54] RETURN DEVICE FOR THE PROJECTILE OF A GRIPPER PROJECTILE WEAVING MACHINE

[75] Inventor: Hans Demuth, Winterthur, Switzerland

[73] Assignee: Sulzer Brothers Limited, Winterthur, Switzerland

[21] Appl. No.: 589,544

[22] Filed: Mar. 14, 1984

[30] Foreign Application Priority Data

Mar. 15, 1983 [DE] Fed. Rep. of Germany ..... 3309145

[51] Int. Cl.[4] ..... D03D 51/18

[52] U.S. Cl. ..... 139/439

[58] Field of Search ..... 139/439, 438, 155, 185

[56] References Cited

U.S. PATENT DOCUMENTS

| | | | |
|---|---|---|---|
| 2,785,701 | 3/1957 | Dunham | 139/438 |
| 4,261,394 | 4/1981 | Sterel | 139/439 |
| 4,330,018 | 5/1982 | Sterel | 139/439 |
| 4,415,010 | 11/1983 | Schmitz | 139/439 |
| 4,460,021 | 7/1984 | Demuth | 139/185 |

FOREIGN PATENT DOCUMENTS

| | | | |
|---|---|---|---|
| 2146742 | 9/1971 | Fed. Rep. of Germany | 139/185 |
| 2415244 | 9/1979 | France | 139/185 |

*Primary Examiner*—Henry S. Jaudon
*Assistant Examiner*—Joseph S. Machuga
*Attorney, Agent, or Firm*—Kenyon & Kenyon

[57] ABSTRACT

The return device for the projectiles of a gripper projectile weaving machine has an end position brake employing an abutment in the form of a piston which is guided in the cylinder and which experiences the light pressure of a restoring spring. The ratio of the mass of the projectile to the mass of the piston at a given projectile speed is such that the projectile stops immediately upon striking the piston. The piston does not experience local wear over extended periods of time and obviates any need for a means to prevent a bounce-back of the projectile.

12 Claims, 3 Drawing Figures

RETURN DEVICE FOR THE PROJECTILE OF A GRIPPER PROJECTILE WEAVING MACHINE

This invention relates to a return device for the projectiles of a gripper projectile weaving machine. More particularly, this invention relates to a brake for a return device in a gripper projectile weaving machine.

As is known, gripper projective weaving machines employ a series of gripper projectiles which can be guided through guide teeth or the like for introducing weft threads into a shed of warp threads. Generally, each projectile with a gripped thread is picked from a picking station through the shed to a catching station and, thereafter, returned to the picking station via a return device.

In some cases, the return device has been constructed as an endless chain onto which the gripper projectiles are deposited and conveyed with the aid of pushers to the picking station. In addition, the picking station has been provided with a projectile-lifter, into which the projectiles are pushed seriatim and subsequently moved into a position for picking into a shed.

In one known return device, the projectiles entering the lift strike an elastomeric abutment associated with the lift and come to a standstill. However, one disadvantage of this device is that the abutment wears locally after a relatively short time. Thus, the projectile ceases to be positioned accurately in the lift relative to a gripper clamp opener used to open the projectile in order to grip a thread. As a consequence, the lift is not able to properly position the projectile for opening.

Another requirement of a return device is that the device must not allow excessive bounce-back of a projectile from the abutment. To this end, the known device has a relatively strong flat spring putting lateral pressure against the projectile for absorbing the impact of the projectile. However, this leads to wear in the lift. In addition, the use of such a strong compression spring also leads to an inaccurate positioning of the projectile for picking or to what is known as a skewed pick with a consequent increased wear of the projectile and any guide teeth defining a guide path for the projectile through a shed.

Accordingly, it is an object of the invention to provide a return device which is able to operate with minimal wear.

It is another object of the invention to provide a return device for projectiles in a gripper projectile weaving machine which is able to accurately position the projectiles for return to a picking station.

It is another object of the invention to provide a brake for a return device in a projectile weaving machine which is able to simply arrest the movement of a projectile for accurate positioning in a lift.

Briefly, the invention provides a return device for the projectiles of a gripper projectile weaving machine. The device includes an end position brake having a cylinder, a piston which is guided within the cylinder to move from an intial position and a braking and restoring device in the cylinder for moving the piston to the initial position. In addition, the piston has a mass relative to the projectile mass to cause the projectile to come to a stop upon striking the piston. In this regard, the ratio of piston mass to projectile mass is between 1:0.65 and 1:0.75.

These and other objects and advantages of the invention will become more apparent from the following detailed description taken in conjunction with the accompanying drawings wherein.

Figure 1:
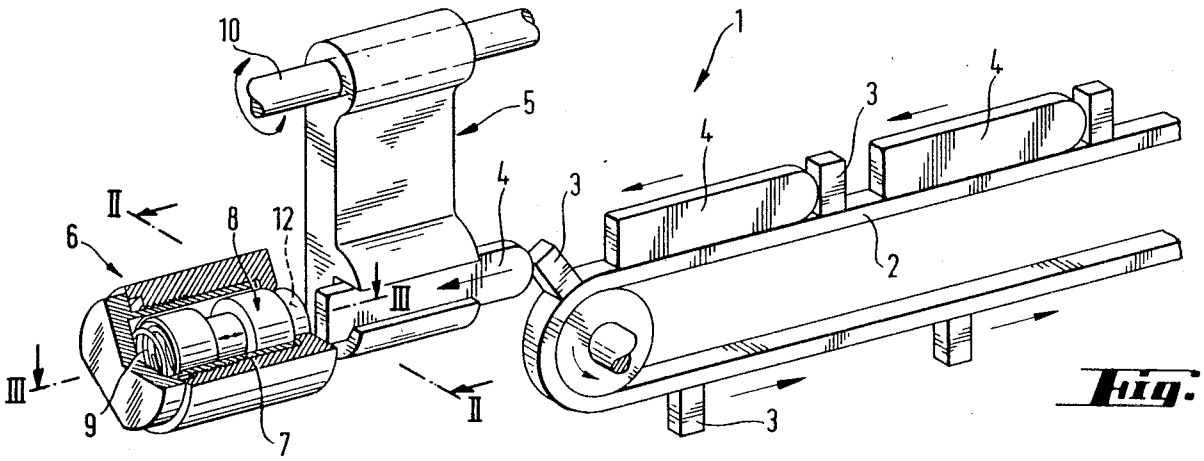
FIG. 1 illustrates a schematic view of a return device employing a brake in accordance with the invention.

Referring to FIG. 1, a return device 1 for a gripper projectile weaving machine includes an endless conveying chain 2 having a plurality of dogs or pushers 3 thereon which are adapted to abut and return a plurality of projectiles 4 from a projectile catcher (not shown) to a picking device (not shown).

In addition, the return device has a projectile lift 5 disposed at the end of the chain 2 for sequentially receiving each projectile 4 of a series of projectiles 4 conveyed on the chain 2. As indicated, each pusher 3 is positioned so as to push a projectile 4 into the lift 5.

The return device 1 also has a brake 6 adjacent the lift 5 for arresting movement of each respective projectile 4 received in the lift 5.

Figure 3:
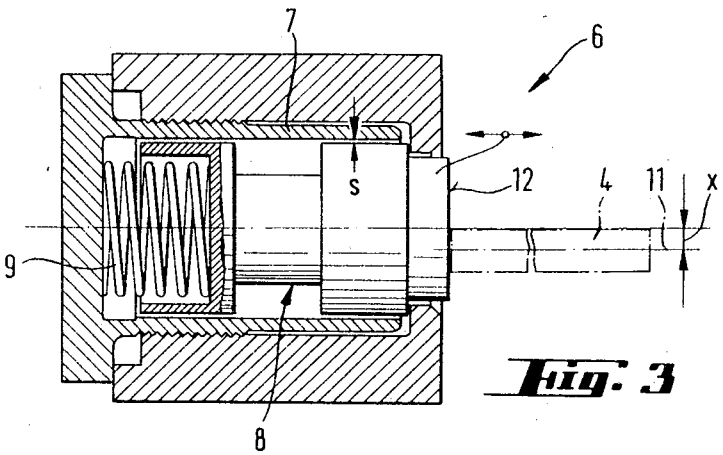
FIG. 3 illustrates a view of the brake of FIG. 1 taken on line III—III of FIG. 1.
Figure 2:
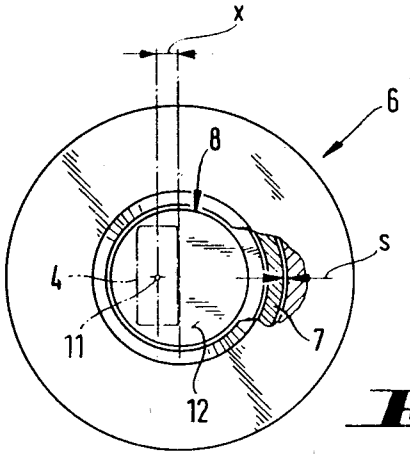
FIG. 2 illustrates a view taken on line II—II of FIG. 1 showing a front view of the brake.

Referring to FIGS. 1 to 3, the brake 6 acts as an end position brake and includes a cylinder 7, a piston 8 which is guided in the cylinder 7 and against which a projectile 4 impacts when received in the lift 5 at an initial position as well as a braking and restoring device in the form of a spring 9 in the cylinder 7 for returning the piston 8 to the initial position after an impact by the projectile 4. As indicated in FIG. 3, the cylinder may be threaded into a housing through which the piston 8 may project at a forward end with an end face 12 projecting slightly beyond the housing. The threading of the cylinder 7 in the housing also permits adjustments to be made from time to time on the spring 9 which is disposed between the piston 8 and the cylinder 7.

The piston 8 is made with a mass relative to the mass of a projectile so that the projectile can be stopped in a stop position immediately upon impact of the projectile 4 against the piston 8 while the piston moves away from the initial position against the bias of the spring 9. An experimentally determined ratio of piston mass to projectile mass is from 1:0.65 to 1:0.75.

In operation, the return device delivers a series of projectiles 4 into the lift 5 seriatim. As each projectile 4 moves into the lift 5 the forward face impacts against the end face 12 of the piston 8 of the brake and immediately stops. At this time, the piston 8 moves into the cylinder 7 against the bias of the spring 9. The lift 5 then pivots upwardly about a spindle 10 so as to bring the projectile 4 into a picking position ready for the next pick.

The piston 8 moves against the spring 9 until the spring 9, in a recoil movement, returns the piston 8 to the initial position (FIG. 3). Of note, during this time, the air column under the piston 8 sustains the braking action. In addition, the spring 9 has a low spring rate such that the reciprocation time of the piston 8 is greater than the dwell time of the projectile 4 in the stop position. That is, the piston 8 is returned to its initial position only after the lift 5 has moved the projectile 4 out of the path of the piston 8 so that the piston 8 and projectile 4 cannot collide.

Referring to FIGS. 2 and 3, the piston 8 is circumferentially spaced from the cylinder 7 to define a clearance s therebetween and has a longitudinal axis offset from a projectile axis 11 parallel thereto. In this way, the projectile 4 strikes the piston 8 asymmetrically and the piston 8 is rotated slowly as experience teaches. This feature has the advantage that the end face 12 of the piston wears very uniformly. As a result, the working life of the projectiles 4 and the piston 8 are extended.

Of note, the piston braking and restoring device may be constructed in other forms than a spring. For example, the braking and restoring device may be in the form of a gas spring or hydraulic spring or an elastomer or a combination of these or even a mechanical restoring device.

The invention thus provides an end position brake for a return device wherein a projectile may be accurately stopped upon impact against a piston in order to permit accurate positioning within a lift and accurate positioning for a gripper clamp opener. The brake is itself constructed in a relatively simple manner of relatively simple parts. Further, after an impulse exchange with a projectile, the piston of the brake is able to recoil, i.e. return to an initial position in a relatively simple manner without interfering with the motion of the lift.

What is claimed is:

1. A return device for projectiles of a gripper projectile weaving machine, said device including an end position brake having a cylinder, a piston guided within said cylinder to move from an initial position thereof upon impact of a projectile thereon and a braking and restoring device in said cylinder for returning said piston to said initial position, said piston having a mass relative to a projectile mass to cause the projectile to come to a stop immediately on impact upon striking said piston in said initial position.

2. A return device as set forth in claim 1 wherein the ratio of piston mass to projectile mass is between 1:0.65 and 1:0.75.

3. A return device as set forth in claim 1 wherein said braking and restoring device is a spring having a spring rate such that the reciprocation time of said piston is greater thn the dwell time of the projectile in the stop position.

4. A return device as set forth in claim 1 wherein said piston is circumferentially spaced from said cylinder to define a clearance therebetween and has a longitudinal axis offset from a projectile axis parallel thereto.

5. A return device for a gripper projectile weaving machine comprising an endless conveying chain for conveying a series of projectiles;

a projectile lift at one end of said conveyor chain for sequentially receiving each projectile of a series of projectiles conveyed on said chain, said lift being movable from a projectile receiving position to a raised position; and a brake adjacent said lift for arresting movement of each respective projectile received in said lift, said brake having a cylinder, a piston guided in said cylinder to abut a projectile received in said lift at an initial position thereof and having a mass relative to the mass of the projectile to stop the projectile in a stop position immediately upon impact of the projectile against said piston while moving away from said initial position, and a braking and restoring device in said cylinder for returning said piston to said initial position.

6. A return device as set forth in claim 5 wherein the ratio of piston mass to projectile mass is between 1:0.65 and 1:0.75.

7. A return device as set forth in claim 5 wherein said piston has a longitudinal axis parallel and offset from a projectile axis.

8. A return device as set forth in claim 5 wherein said braking and restoring device is a spring.

9. A return device as set forth in claim 8 wherein said spring has a spring rate such that the reciprocation time of said piston in moving from and to said initial position is greater than a dwell time of a projectile in said stop position.

10. A return device as set forth in claim 9 wherein the ratio of piston mass of projectile mass is between 1:0.65 and 1:0.75.

11. A brake for a return device in a gripper projectile weaving machine, said brake comprising a cylinder;

a piston guided in said cylinder to abut a gripper projectile at an initial position thereof and having a mass relative to the mass of the projectile to stop the projectile in a stop position immediately upon impact of the projectile against said piston while moving away from said initial position; and a braking and restoring device in said cylinder for returning said piston to said initial position.

12. A brake as set forth in claim 11 wherein the ratio of piston mass to projectile mass is between 1:0.65 and 1:0.75.

* * * * *

UNITED STATES PATENT AND TRADEMARK OFFICE

CERTIFICATE OF CORRECTION

PATENT NO. : 4,586,542

DATED : May 6, 1986

INVENTOR(S) : HANS DEMUTH

It is certified that error appears in the above-identified patent and that said Letters Patent is hereby corrected as shown below:

Column 1, line 9 change "projective" to -projectile-

Column 1, line 60 change "intial" to -initial-

Column 3, line 41 change "thn" to -than-

Column 4, line 33 change "of" , second occurrence, to read -- to --.

Signed and Sealed this

Fourteenth Day of October, 1986

[SEAL]

*Attest:*

DONALD J. QUIGG

*Attesting Officer*

*Commissioner of Patents and Trademarks*